US005323874A

United States Patent [19]

Warren et al.

[11] Patent Number: 5,323,874

[45] Date of Patent: Jun. 28, 1994

[54] COMBINATION LADDER AND STAIR

[75] Inventors: Mitchell R. Warren; Daniel J. Dittberner; Grant M. Strawcutter, all of Charlotte, N.C.

[73] Assignee: Soft Play, Inc., Charlotte, N.C.

[21] Appl. No.: 117,420

[22] Filed: Sep. 7, 1993

[51] Int. Cl.[5] ..... A63B 9/00

[52] U.S. Cl. ..... 182/129; 182/194; 482/35; 52/182

[58] Field of Search ..... 182/129, 194, 228, 49; 52/182; 482/35, 36, 37; 472/116

[56] References Cited

U.S. PATENT DOCUMENTS 2,620,185 12/1952 Hardin ..... 482/35
4,447,055 5/1984 Ahrens ..... 482/35
4,932,648 6/1990 Ahrens ..... 472/116

*Primary Examiner*—Alvin C. Chin-Shue
*Attorney, Agent, or Firm*—Olive & Olive

[57] ABSTRACT

The invention disclosed comprises a combination ladder and stair for use by children which incorporates stair-like treads and risers with ladder-like rungs to achieve safe climbing activity. The combination ladder and stair is adapted to be used at a comparatively steep angle to the ground with the treads being maintained level. The rungs are placed adjacent to and level with each tread to afford additional security for the foot, and are spaced from the tread to allow the hand to grasp around the rung. In the preferred embodiment the ladder is incorporated into a split tube which serves as an entry to a children's play system.

12 Claims, 3 Drawing Sheets

COMBINATION LADDER AND STAIR

BACKGROUND OF THE INVENTION

1. Field of the Invention

This invention relates to ladders, and more particularly ladders intended for use by children in conjunction with recreational equipment, such as playground equipment.

2. Description of the Related Art

There are large numbers of installations of play equipment designed for children in conjunction with family, or "fast food", restaurant, and also in businesses which are primarily devoted to recreational activities. Inherent in use of the equipment is the need for the child user to frequently climb from one level to another.

Known climbing devices are generally classed as either stairs or ladders. Stairs typically cover a comparatively large amount of floor area for the amount of height traveled as seen by a climb angle of about 30°. Ladders typically have a comparatively steep climb angle. Ladders tend to be difficult and somewhat dangerous for young children to use, because the rungs do not securely support the child's foot, but allow it to easily slip off the rung. It is recognized however that a ladder is a more interesting climbing apparatus than are stairs.

It is therefore an object of this invention to provide a climbing device which is easy and safe for children to climb.

It is a further object of the invention to provide a climbing device which occupies a small amount of floor space in comparison to its vertical height.

It is an additional object of the invention to provide a climbing device which is attractive and interesting to children.

Other objects and advantages will be more fully apparent from the following disclosure and appended claims.

SUMMARY OF THE INVENTION

The present invention provides a ladder for use in an array of playground equipment or other children's recreational equipment in climbing from one level to another. The ladder is formed like a set of stairs with enclosed treads and risers being mounted at a steep angle to the ground. A series of round rungs are each assembled to the stair structure level with each tread and at a distance away from the stair tread to allow the climber to hold the rung by hand. In this configuration, the climber has the dual security of holding a rung with his or her hands and placing the foot on a flat, level, enclosed tread.

DETAILED DESCRIPTION OF THE INVENTION

Figure 1:
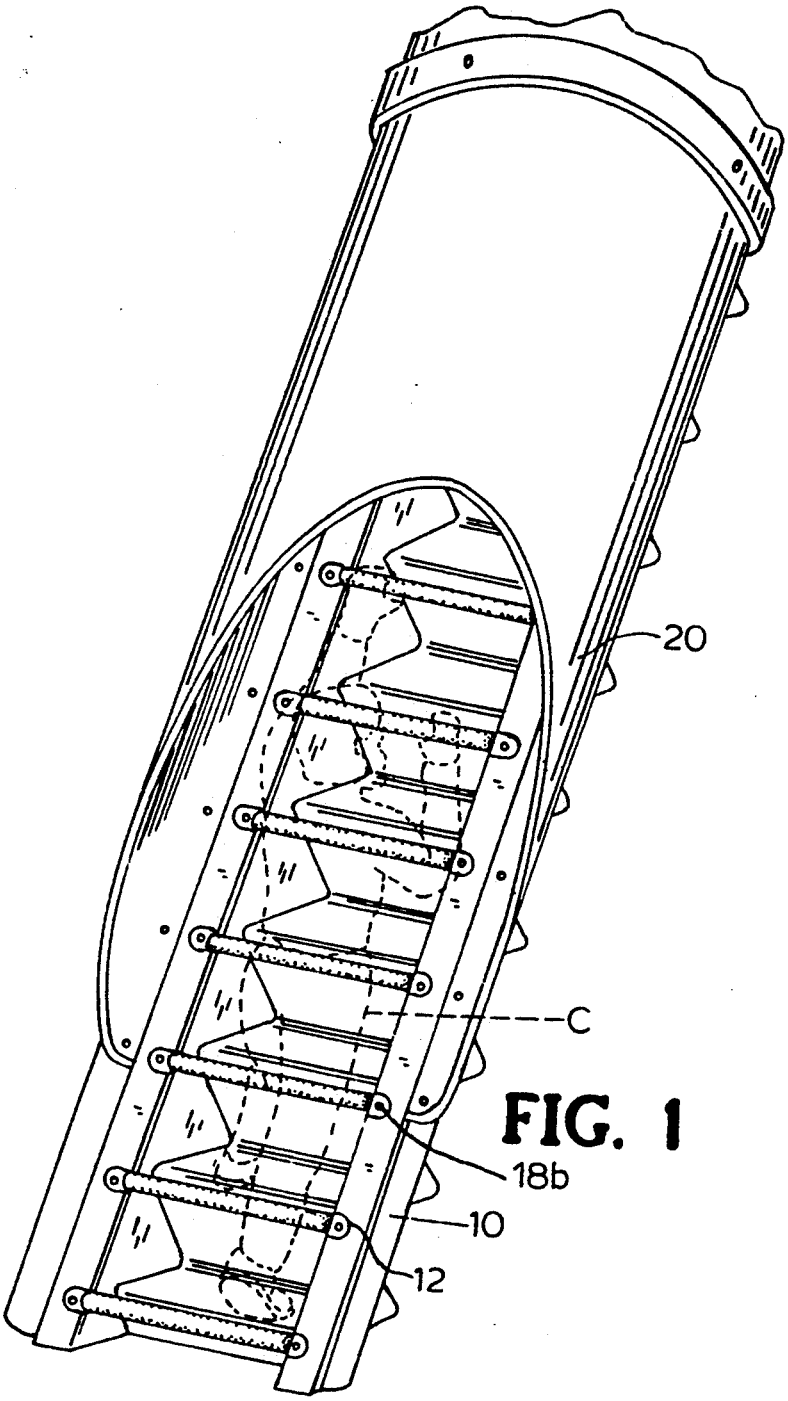
FIG. 1 is a perspective view of the combination ladder and stair of the invention installed partially within a steeply angled tubular tunnel of the sort used in children's recreational equipment.

The invention disclosed is directed to a safe and easy to use device for children to climb, which is comparatively interesting and which proceeds from a first to a second level at a steep angle. The recreational ladder of the invention is particularly directed to use in children's playground systems. As illustrated in FIG. 1, child C is shown climbing the stair portion 10, having attached rungs 12. Child C is about to enter split tube 20. The rungs 12 are useable both as secure handles for grasping and pulling up and as a partial support for the foot of the climber. The invention recognizes that by mounting rungs 12 parallel to the steps of stair portion 10, better hand support is provided than is possible with the traditional side-mounted hand rails generally used with stairs. Split tube 20 may serve generally as an entry port to additional recreational equipment situated at a higher level.

Figure 2:
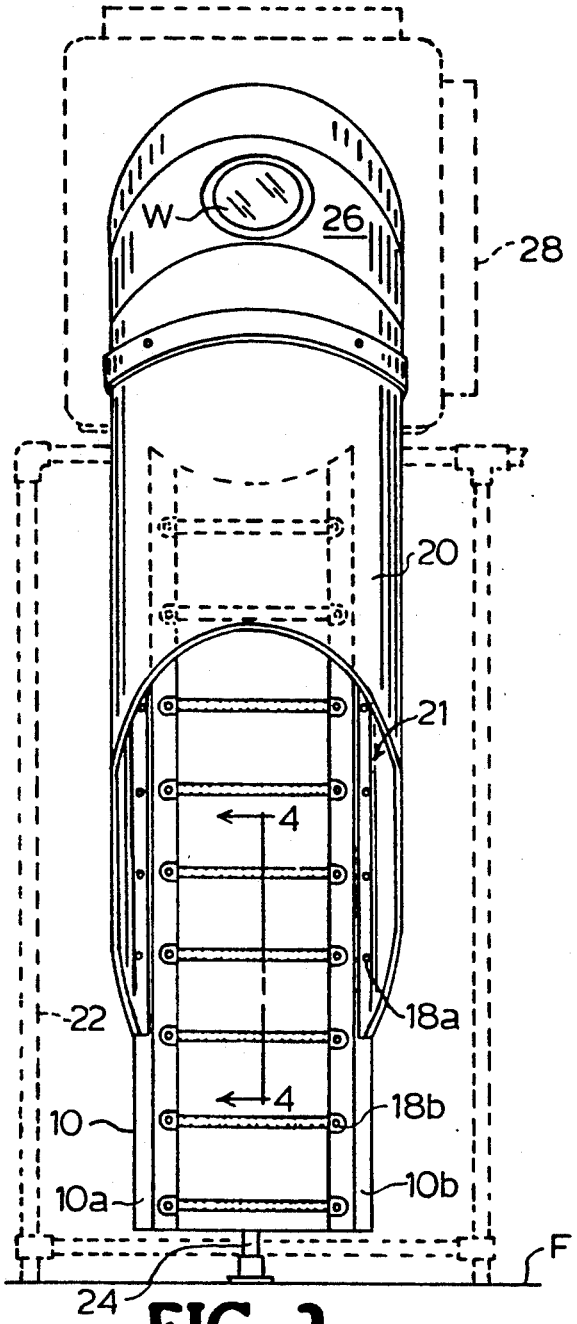
FIG. 2 is a front elevation view of the combination ladder and stair within the tube as illustrated in FIG. 1.

FIG. 2 shows the invention stair portion 10 with assembled rungs 12 in front elevation as assembled into tube 20. The lower end of split tube 20 is formed with an opening 21 residing substantially in a plane positioned at an angle to the axis of tube 20. The angled tube opening 21 allows the climber to enter the split tube 20 in an upright position. Stair poriton 10 is typically supported at its lower end by a structure such as foot 24, fixedly connected to a mounting surface F. Split tube 20 and stair portion 10 are held in position at their mutual upper end by elbow 26 which is fixedly connected to box 28, which is in turn supported by structural frame support 22. Elbow 26 includes window W for improved lighting within split tube 20. In the preferred embodiment, split tube 20 is configured as a partial cylinder having a portion of its wall removed (see FIG. 6). Stair portion 10 is placed against the opposed edges of the wall of tube 20, essentially filling the gap in the cylinder, and respective edges 10*a*, 10*b* are attached fixedly by means of a series of fastening means, such as, for example, rivets 18*a*. Similarly, a series of rungs 12 are affixed to both edges 10*a*, 10*b* of ladder 12 by means of rivets 18*b*.

Figure 4:
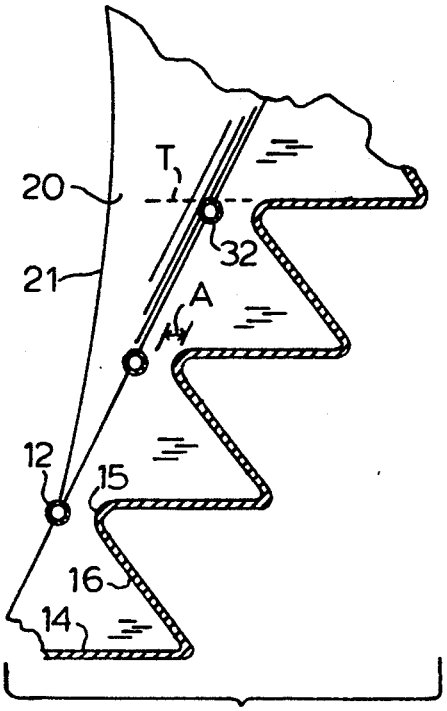
FIG. 4 is a partial cross sectional view of the combination ladder and stair and tube as taken in the direction of line 4—4 of FIG. 2.

The relationship between rungs 12 and treads 14 is illustrated in cross sectional detail in FIG. 4. Typically, one rung 12 is employed at each tread 14, although the lowest several rungs 12 may be optionally left out. Each rung 12 is mounted to ladder 10 in a position so that a straight line drawn along the upper surface of a respective tread 14 forms a tangent T to the uppermost portion of the tubular central body 32 of rung 12. The rungs 12 are assembled to side rails 10*a*, 10*b* parallel to step nose 15 so as to maintain a space A between each rung 12 and the nose 15 of each step formed of a tread 14 and a riser 16 so as to allow the insertion of the fingers of the climber. The shape and angle of each riser 16 is somewhat a matter of design, but must fit within the overall dimensions of the apparatus.

The main body of stair portion 10 comprises a pair of side rails 10*a* and 10*b*, a series of parallel treads 14 and a series of parallel risers 16 being each riser 16 positioned at an angle to treads 14. A variation of the preferred embodiment is to form side rails 10 and treads 14 as described, and not include any riser. Stair portion 10 is formed, according to the preferred embodiment, by a plastic forming process, such as, for example, rotational molding or vacuum forming, preferably of a medium density polyethylene resin.

When the child user climbs stair portion 10, he or she grasps successive rungs 12 and places his or her feet on successive treads 14, possibly with the heel on a rung 12. Each riser 16 serves to enclose the rear of the stair portion 10 so as to improve safety by preventing the child's foot from slipping off rearwardly as well as to add support for treads 14.

Figure 3:
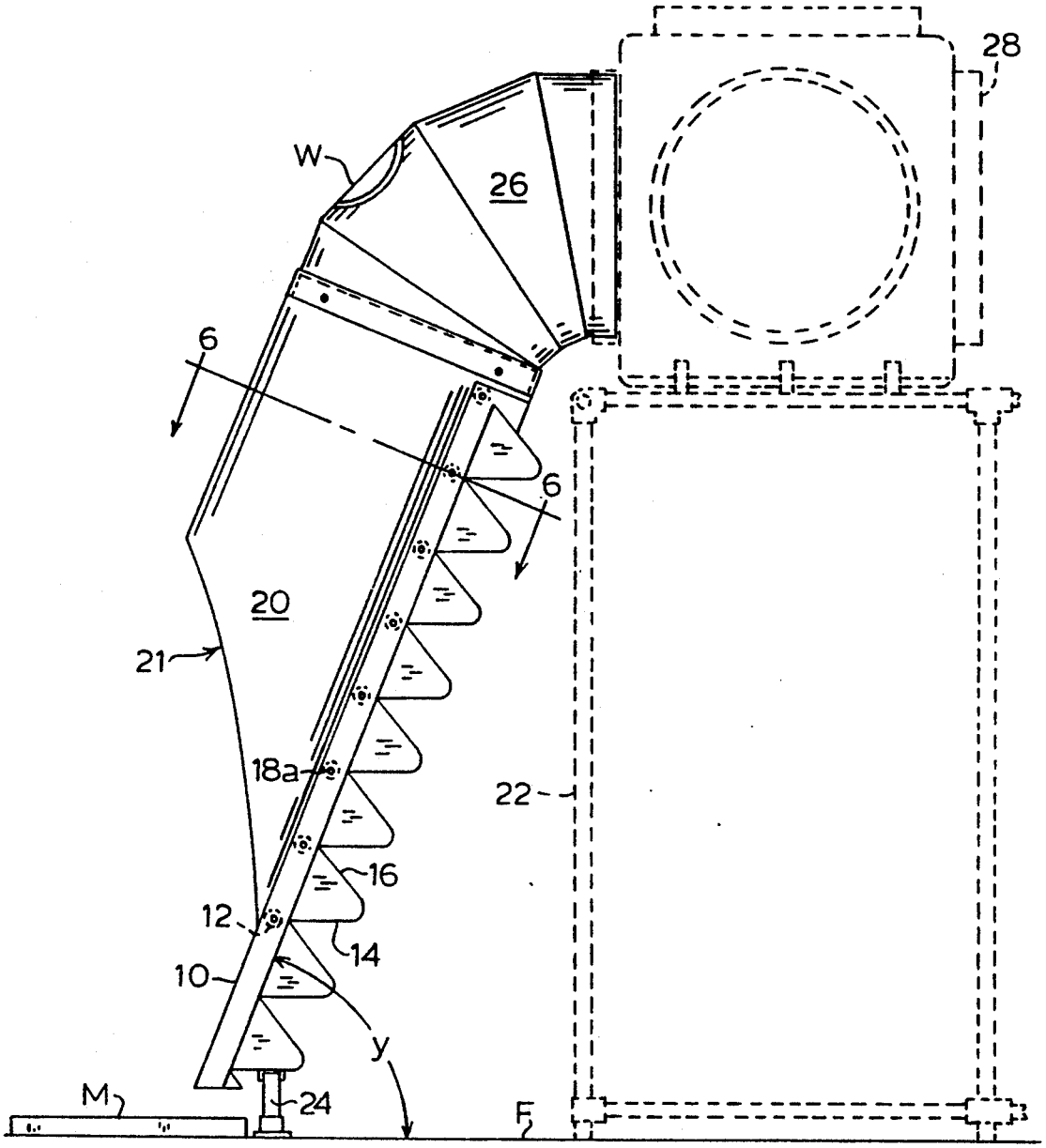
FIG. 3 is a side elevation view of the combination ladder and stair within the tube of FIG. 1.

FIG. 3 illustrates, in side elevation view, the stair portion 10 of the invention mounted at an angle Y such that treads 14 are situated in a series of substantially horizontal planes. Climb angle Y is greater than 45°, and is approximately 67° in the preferred embodiment so as to minimize the amount of floor or ground area occupied by stair portion 10 and increase the interest of the climber. Split tube 20 is shown in typical side view having its tube opening 21 disposed in a plane which is at an acute angle to a plane defined by the opposed edges of the split tube 20 which retain sufficient connection surface with stair portion 10 so as to not interfere with the head of the users by forming the upper edge of tube opening 21 higher than the head height of the tallest expected child. Tube opening 21 is substantially in a vertical plane when split tube 20 is mounted on ladder 10 in the manner described. A resilient safety pad M is placed on surface F at the bottom of ladder 10 to serve as a cushion in case of an accidental fall.

Figure 6:
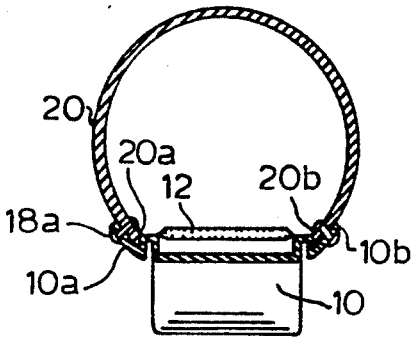
FIG. 6 is a cross sectional view of the combination ladder and stair of the invention and the mounting tube therefor taken in the direction of line 6—6 of FIG. 3.

The assembly of the combination ladder and stair 10 to split tube 20 is illustrated in cross section in FIG. 6. Split tube 20 is a partial cylinder having an open portion between edges 20*a* and 20*b*. The spacing between edges 20*a* and 20*b* is configured to accept stair portion 10 and engage complementarily curved ladder edges 10*a* and 10*b*. The assembly is preferred to be secured with rivets 18*a*, but other means of fastening may be employed. When assembled, the combination ladder and stair 10 closes the gap in split tube 20 to form a closed tube.

Figure 5:
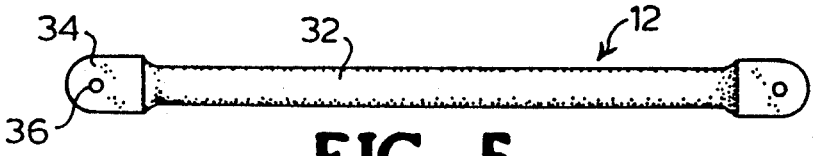
FIG. 5 is a front elevation view of a rung of the combination ladder and stair of the invention.

Each rung 12 employed in the preferred embodiment is formed of tubular, malleable metal, and a typical rung is shown in front elevation in FIG. 5. Rung body 32 retains a tubular cross section and a mounting tab 34 on each end thereof is pressed flat being then wider than tube body 32. A mounting hole 36 is formed in each mounting tab 34 and positioned to fit matching holes in side rails 10*a* and 10*b* and to be mounted thereto by means of rivets 18*b* or otherwise.

As the child C (FIG. 1) climbs up into split tube 20, he or she grasps a next higher rung 12 with a hand and steps onto a tread 14, lifting upwards. Due to the secure and easily accessible mounting position of rungs 14, the climbing activity is relatively easy, even for inexperienced climbers. The relatively steep climb angle and the act of climbing upward into a tube combine to make the climb more interesting than prior art stairs. The rungs and the enclosing risers make the ladder of the invention safer than prior art ladders.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A combination ladder and stair, comprising:

(a) a stair portion, having;

(i) a pair of substantially parallel, spaced apart side rails;

(ii) a plurality of mutually parallel planar treads each having a rear edge and a forward edge and being fixedly secured between said side rails; and (b) a series of elongate rungs each of which is fixedly mounted to both side rails so as to be substantially parallel to the forward edge of each said tread and spaced from said forward edge so that a climber is able to wrap a hand around each said rung in turn as the climber climbs the combination ladder and stair.

2. The combination ladder and stair as claimed in claim 1, further comprising a plurality of mutually parallel risers each having an upper edge and a lower edge and being fixedly secured between said side rails with said upper edge thereof being secured to said forward edge of one said tread and said lower edge thereof secured to said rear edge of another said tread.

3. The combination ladder and stair as claimed in claim 1 wherein said series of rungs are mounted to said side rails so that an extension of a line connecting said rear edge and said forward edge of each said tread forms a tangent to a top of each said respective rung.

4. The combination ladder and stair as claimed in claim 2 wherein selected portions of said side rails are secured to complementary edges of a split tube in a manner so that said treads and risers complete the formation of a tube.

5. The combination ladder and stair as claimed in claim 2 wherein said side rails reside at a climb angle greater than 45°.

6. The combination ladder and stair as claimed in claim 4 wherein said plurality of treads are maintained substantially horizontal when said side rails reside at said comparatively steep climb angle.

7. A combination ladder and stair, comprising:

(a) a stair portion, having;

(i) a pair of substantially parallel, spaced apart side rails;

(ii) a plurality of mutually parallel planar treads each having a rear edge and a forward edge and being fixedly secured between said side rails;

(iii) a plurality of mutually parallel risers each having an upper edge and a lower edge and being fixedly secured between said side rails with said upper edge thereof being secured to said forward edge of one said tread and said lower edge thereof secured to said rear edge of another said tread;

(b) a series of elongate rungs each of which is fixedly mounted to both side rails so as to be substantially parallel to the forward edge of a respective said tread and spaced from said forward edge so that a climber is able to wrap a hand around each said rung in turn as the climber climbs the combination ladder and stair; and (c) a split tube having a first and a second end and configured to engage said side rails of said combination ladder and stair.

8. The combination ladder and stair according to claim 6 wherein said split tube is substantially cylindrical.

9. The combination ladder and stair according to claim 6 wherein said tube is formed with a longitudinal gap between a pair of substantially parallel edges thereof.

10. The combination ladder and stair as claimed in claim 6 wherein said side rails reside at a climb angle greater than 45°.

11. The combination ladder and stair as claimed in claim 9 wherein said plurality of treads are maintained substantially horizontal when said side rails reside at said climb angle greater than 45°.

12. The combination ladder and stair according to claim 6 wherein said second end of said split tube is formed at an acute angle to a plane defined by said pair of substantially parallel edges of said split tube so as to form a substantially vertical opening of said tube when mounted on said side rails.

* * * * *